US007694990B2

(12) United States Patent
Goertzen et al.

(10) Patent No.: US 7,694,990 B2
(45) Date of Patent: Apr. 13, 2010

(54) ANTI-TIP WHEELCHAIR

(75) Inventors: Gerold Goertzen, Brunswick, OH (US); Michael Nemcek, Avon, OH (US)

(73) Assignee: Invacare Corporation, Elyria, OH (US)

( * ) Notice: Subject to any disclaimer, the term of this patent is extended or adjusted under 35 U.S.C. 154(b) by 749 days.

(21) Appl. No.: 11/270,140

(22) Filed: Nov. 9, 2005

(65) Prior Publication Data

US 2006/0097478 A1 May 11, 2006

Related U.S. Application Data

(60) Provisional application No. 60/626,437, filed on Nov. 9, 2004.

(51) Int. Cl.
*A61G 5/10* (2006.01)

(52) U.S. Cl. ..... 280/304.1; 280/288.4; 280/304.2

(58) Field of Classification Search ..... 280/304.1, 280/288.4
See application file for complete search history.

(56) References Cited

U.S. PATENT DOCUMENTS

| | | | | |
|---|---|---|---|---|
| 4,128,137 | A | | 12/1978 | Booth |
| 4,245,847 | A | | 1/1981 | Knott |
| 4,310,167 | A | | 1/1982 | McLaurin |
| 5,294,141 | A | | 3/1994 | Mentessi et al. |
| 5,435,404 | A | | 7/1995 | Garin, III |
| 5,540,297 | A | | 7/1996 | Meier |
| 5,575,348 | A | | 11/1996 | Goertzen et al. |
| 5,848,658 | A | | 12/1998 | Pulver |
| 5,855,387 | A | | 1/1999 | Gill et al. |
| 5,957,474 | A | | 9/1999 | Mundy et al. |
| 5,964,473 | A | | 10/1999 | Degonda et al. |
| 6,041,876 | A | * | 3/2000 | Pulver et al. ..... 180/65.1 |
| 6,047,979 | A | * | 4/2000 | Kraft et al. ..... 280/250.1 |
| 6,129,165 | A | * | 10/2000 | Schaffner et al. ..... 180/65.1 |

(Continued)

FOREIGN PATENT DOCUMENTS

JP 2941930 10/1990

OTHER PUBLICATIONS

Office action from U.S. Appl. No. 11/334,295 dated Nov. 16, 2007.

(Continued)

*Primary Examiner*—Lesley Morris
*Assistant Examiner*—Tashiana Adams
(74) *Attorney, Agent, or Firm*—Calfee Halter & Griswold LLP

(57) ABSTRACT

A manually-powered wheelchair that includes one or more features that enhance the overall maneuverability and stability of the wheelchair, such as centrally mounted drive-wheels and an anti-tip system. Other embodiments may include at least one of an adjustable anti-tip system that may be selectively located to several locations on the frame; a positive stop device attached to either the mounting bracket, frame, or the anti-tip system for limiting movement of the anti-tip system and the frame relative to each other; a resistance device attached to the frame and the anti-tip system for increasing resistance between the frame and the anti-tip system when the user leans backwards in the wheelchair; a wheel lock system engaging at least one of the drive wheels below the wheel's axis of rotation; and a tilt prevention device for selectively preventing any rotation of the wheelchair frame and anti-tip system relative to each other.

26 Claims, 11 Drawing Sheets

U.S. PATENT DOCUMENTS

| | | | | |
|---|---|---|---|---|
| 6,131,679 | A * | 10/2000 | Pulver et al. | 180/65.1 |
| 6,196,343 | B1 | 3/2001 | Strautnieks | |
| 6,312,002 | B1 * | 11/2001 | Slagerman | 280/304.1 |
| 6,454,286 | B1 | 9/2002 | Hosino | |
| 6,467,788 | B1 | 10/2002 | Li et al. | |
| 6,530,598 | B1 | 3/2003 | Kirby | |
| 6,554,086 | B1 | 4/2003 | Goertzen et al. | |
| 6,923,280 | B2 | 8/2005 | Goertzen et al. | |
| 6,935,448 | B2 | 8/2005 | Goertzen et al. | |
| 7,040,429 | B2 | 5/2006 | Molnar | |
| 7,055,634 | B2 | 6/2006 | Molnar | |
| 7,066,290 | B2 | 6/2006 | Fought | |
| 7,219,755 | B2 | 5/2007 | Goertzen et al. | |
| 7,252,300 | B2 * | 8/2007 | Hargroder | 280/304.1 |
| 7,374,002 | B2 | 5/2008 | Fought | |
| 2001/0008335 | A1 | 7/2001 | Roche | |
| 2002/0153697 | A1 * | 10/2002 | Amirola | 280/304.1 |
| 2004/0004342 | A1 * | 1/2004 | Mulhern et al. | 280/304.1 |
| 2004/0046358 | A1 * | 3/2004 | White et al. | 280/304.1 |
| 2006/0255581 | A1 * | 11/2006 | Goertzen et al. | 280/755 |

OTHER PUBLICATIONS

Amendment from U.S. Appl. No. 11/334,295 dated Feb. 18, 2008.
Notice of Allowance from U.S. Appl. No. 11/334,295 dated May 2, 2008.

* cited by examiner

ANTI-TIP WHEELCHAIR

PRIORITY CLAM

This application claims priority to U.S. Provisional Patent Application 60/626,437, filed Nov. 9, 2004, which is incorporated herein by reference, in its entirety.

STATEMENT REGARDING FEDERALLY FUNDED RESEARCH

This invention was not made by an agency of the United States Government nor under contract with an agency of the United States Government.

TECHNICAL FIELD

This invention relates generally to wheeled conveyances, and more specifically to a manually powered wheelchair that includes a system for increasing maneuverability while preventing the wheelchair from tipping backwards.

BACKGROUND

Many commercially available manual wheelchairs include two relatively large drive wheels that are mounted on the rear portion of the chair's frame and two smaller wheels or casters mounted on the front portion of the chair's frame. This common configuration for wheelchairs typically provides a chair that distributes approximately 65% of the user's weight over the rear drive wheels. Despite sufficient lateral and forward stability, chairs that include the described wheel configuration are often somewhat difficult to maneuver and may have the potential to tip backwards. While this backwards motion may be somewhat helpful in assisting the chair's occupant to raise the front wheels of the chair over curbs and other obstacles, user error or inexperience can cause the chair to be used in a manner to cause it to tip completely over in a backwards direction. In addition, many commercially available wheelchairs include drive wheels that are more centrally mounted to improve the maneuverability of the wheelchair. While such chairs are more easily maneuvered, are even more inclined to tip backwards because most of the user's weight is located closer to the axis of rotation of the drive wheels. Thus, a potential hazard with many prior art manual wheelchairs is the potential for the chair to tip over backwards. Thus, there is a need for a manual wheelchair that provides greater overall maneuverability and stability to the user of the chair.

SUMMARY

The exemplary embodiments of the present invention provide a manually-powered wheelchair that includes one or more features that enhance the overall maneuverability and stability of the wheelchair. The exemplary embodiment of the present invention provides a manually powered anti-tip wheelchair that includes a frame for supporting a user of the wheelchair; at least one pivot arm pivotally connected to each side of the frame at a pivot point positioned between distal and proximal ends of the pivot arm, wherein each of the pivot arms carries a caster at its distal end, wherein each of the pivot arms carries a drive wheel at its proximal end, wherein the drive wheels are mounted to the wheelchair with the axis of rotation of the drive wheels positioned forward of the pivot point, and wherein the drive wheels are positioned substantially beneath the center of gravity of a user of the wheel chair. Other embodiments may include an adjustable anti-tip mechanism that may be selectively located to several locations on the frame; at least one of a positive stop device attached to either the mounting bracket, frame, or the pivot arm for limiting movement of the pivot arm and the frame relative to each other; a resistance device attached to the frame and the pivot arm for increasing resistance between the frame and the pivot arm when the user leans backwards in the chair; and a wheel lock system engaging at least one of the drive wheels below the wheel's axis of rotation.

Additional features and aspects of the present invention will become apparent to those of ordinary skill in the art upon reading and understanding the following detailed description of the exemplary embodiments.

BRIEF DESCRIPTION OF THE DRAWINGS

The accompanying drawings, which are incorporated into and form a part of the specification, schematically illustrate one or more exemplary embodiments of the invention and, together with the general description given above and detailed description of the exemplary embodiments given below, serve to explain the principles of the invention.

DETAILED DESCRIPTION

The exemplary embodiments of the present invention shown in the Figures provide a manually-powered wheelchair that includes one or more features that enhance the overall maneuverability and stability of the wheelchair. In accordance with one aspect of the present invention, forward-mounted drive wheels are provided. These drive wheels are operatively connected to the pivot arm at a position that places a significant portion of the weight of the user, i.e., the user's center of gravity, over the drive wheels, thereby making the chair easier to maneuver. In accordance with another aspect of the present invention, an anti-tip system is provided. This anti-tip system may include at least one rearwardly extending pivot arm pivotally connected to the frame of the wheelchair. A caster may be attached to one end of the pivot arm to make contact with the substrate behind the drive wheels, thereby providing a means for preventing the wheelchair from tipping over backwards. Exemplary anti-tip systems may include an optional tilt stop for limiting movement of the pivot arm and the frame relative to each other. Exemplary anti-tip systems may also include a resistance device attached to the frame of the wheelchair and to the pivot arm. In accordance with yet another aspect of the present invention, at least one wheel lock subassembly may be provided. The wheel lock subassembly may have a portion that engages at least one of the drive wheels at a point below the central axis of the drive wheel, thereby providing a means for preventing the inadvertent release of the wheel lock when the chair is tilted backwards.

Figure 1:
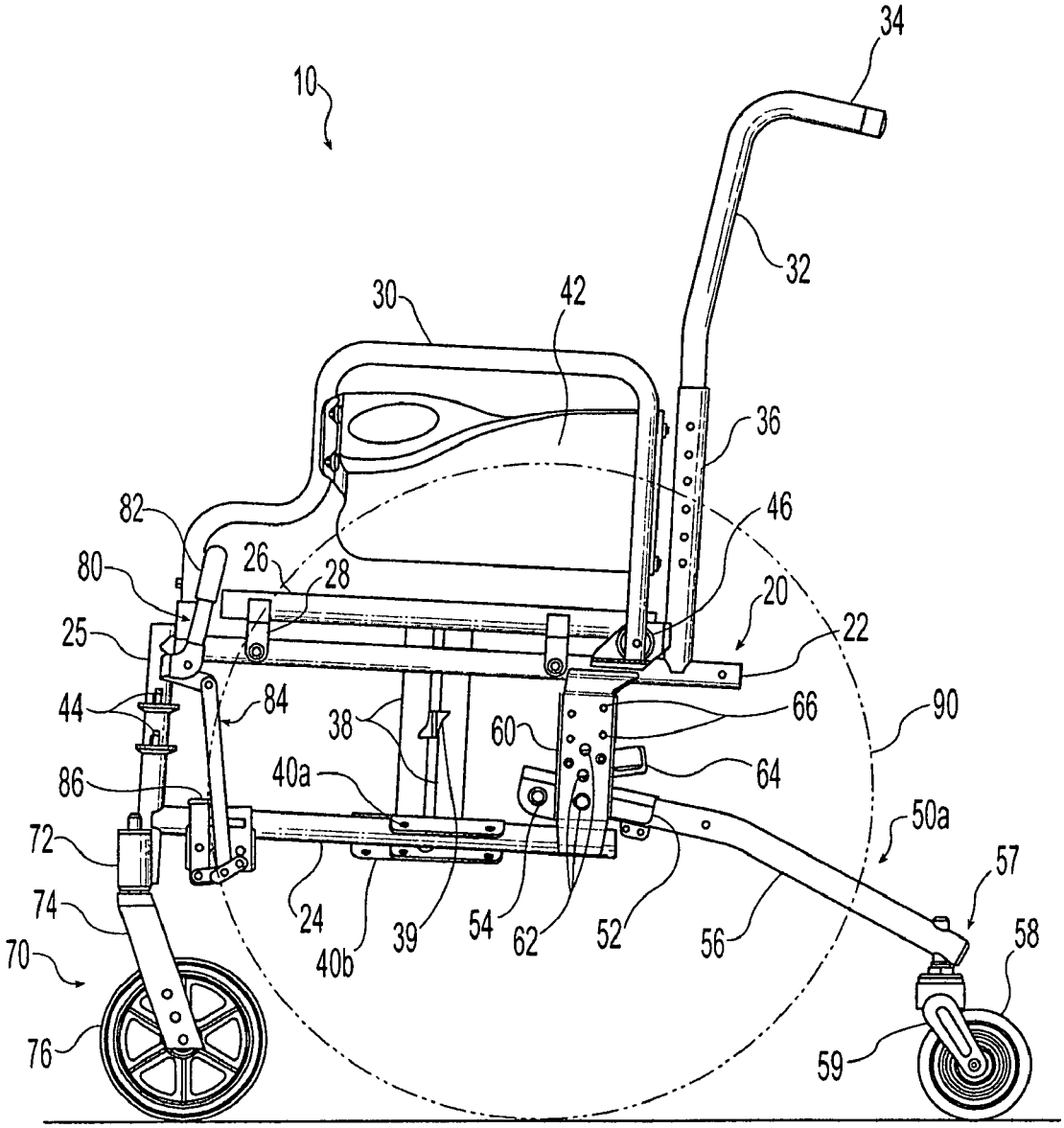
FIG. 1 is a side view of an exemplary embodiment of a wheelchair of the present invention wherein the drive wheels have been removed and outlined in broken lines to better show the frame of the wheelchair, one of the pivot arm and rear caster subassemblies, and one of the wheel lock subassemblies.
Figure 2:
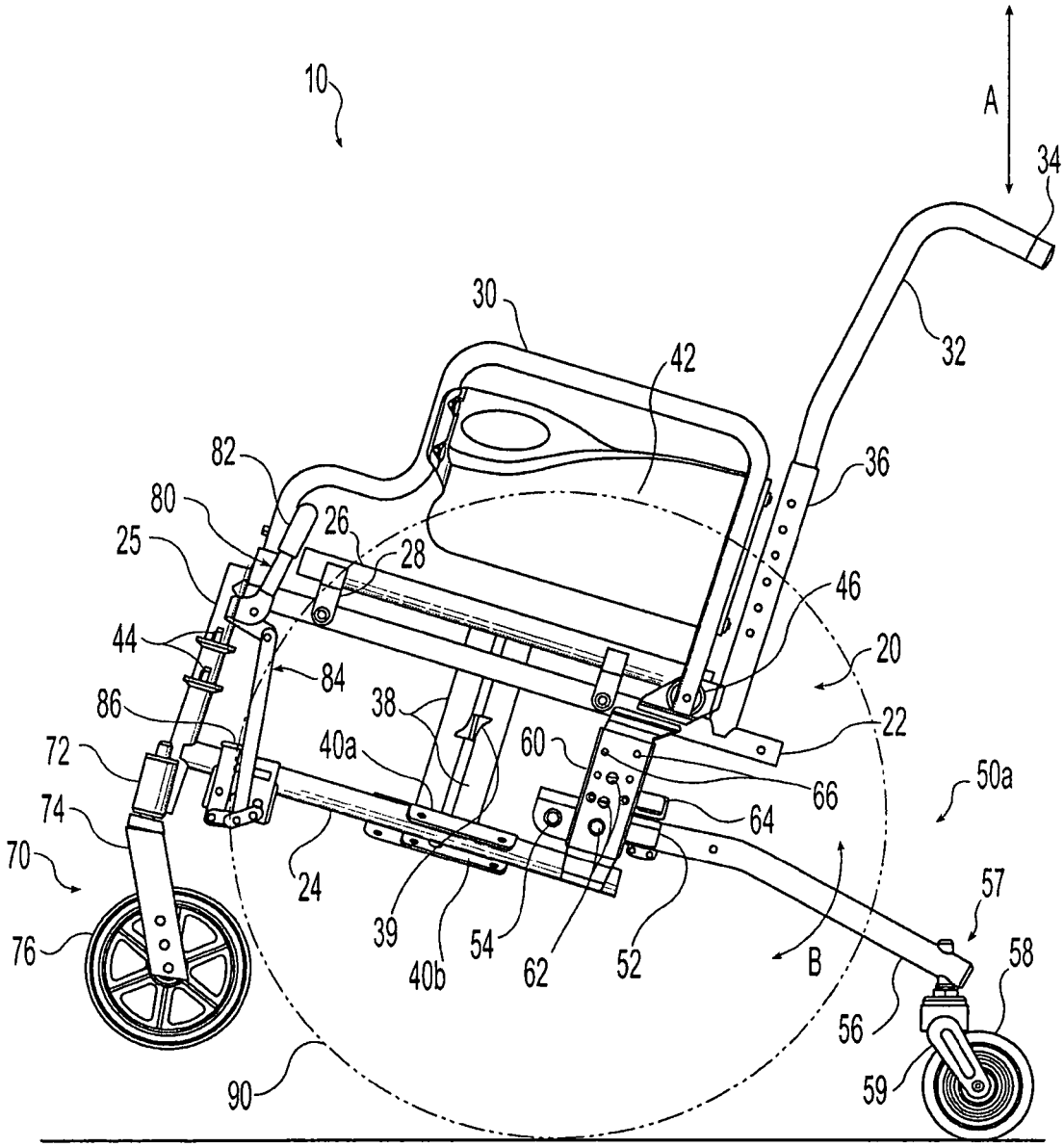
FIG. 2 is a side view of the exemplary embodiment of FIG. 1 showing, with the drive wheels removed and outlined in broken lines, the wheelchair in a position after the seat is rotated backwards.
Figure 3:
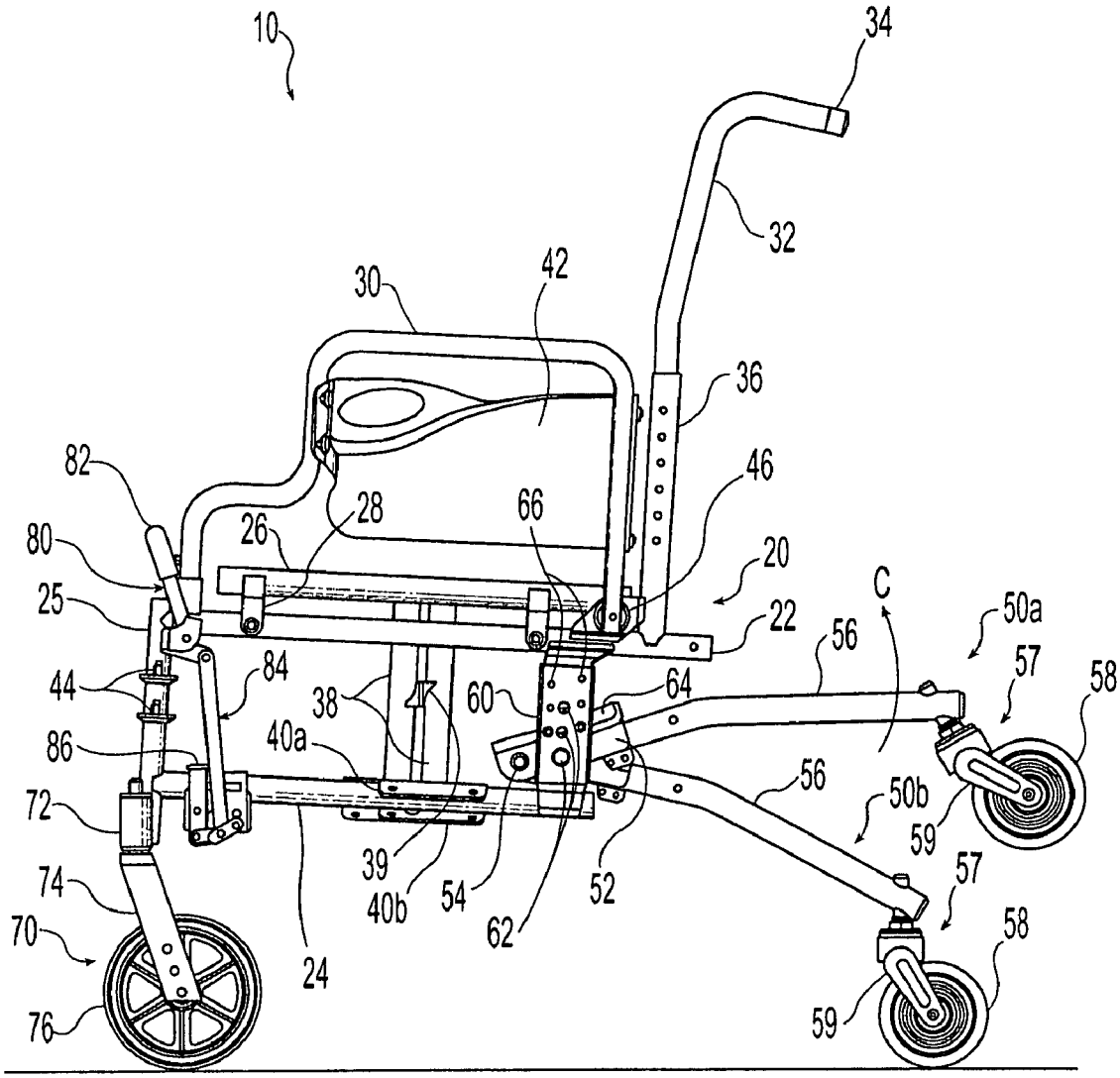
FIG. 3 is a side view of the exemplary embodiment of FIG. 1 showing, with the drive wheels removed, an exemplary upward most position of one of the pivot arm and rear caster subassemblies, with the rotation being limited by an exemplary tilt-stop.

As best shown in FIGS. 1-3 and 5-6, an exemplary embodiment of anti-tip wheelchair 10 includes a metal frame 20, first and second pivot arm and rear caster assemblies 50*a* and 50*b*, front caster subassemblies 70, wheel lock subassemblies 80, and drive wheels 90. The frame 20 provides the primary structural support for the various components of the wheelchair 10 and includes at least upper frame tubes 22, lower frame tubes 24, and front frame tubes 25. As partially shown in FIG. 7, these structural aspects of the wheelchair 10 may be found on both the left and right sides of chair 10. Seat supports 26 provide support for the fabric or material comprising the seat. As best shown in FIGS. 1-3, seat support brackets 28 accept and support the seat supports 26 on the upper frame tubes 22 when the wheelchair 10 is in its open position (non-collapsed configuration) for use. Arm rest support tube 30 is also mounted on upper frame tube 22 and provides a support not only for the arm rests (see FIG. 7), but also for clothing guards 42. Arm rest pivot brackets 46 provide a reinforced means for attaching the rear portion of arm rest support tubes 30 to upper frame tubes 22 and also provide a reinforced means for attaching optional height adjustment tube 36. Back canes 32, which provide support for the fabric or upholstery comprising seat back 43, are securable at various extensions or heights within height adjustment tubes 36, which are a portion of frame 20. Additional embodiments of the present invention may include back canes 32 that are not adjustable. The tubes forming back canes 32 may terminate with push handles 34, which may be utilized by an individual assisting the person sitting in the chair for the purpose of pushing, pulling, or turning the wheelchair. It should be apparent to one skilled in the art that the general configuration and construction of the frame 20 may vary widely and the present invention is not limited to the frame as herein described.

Figure 7:
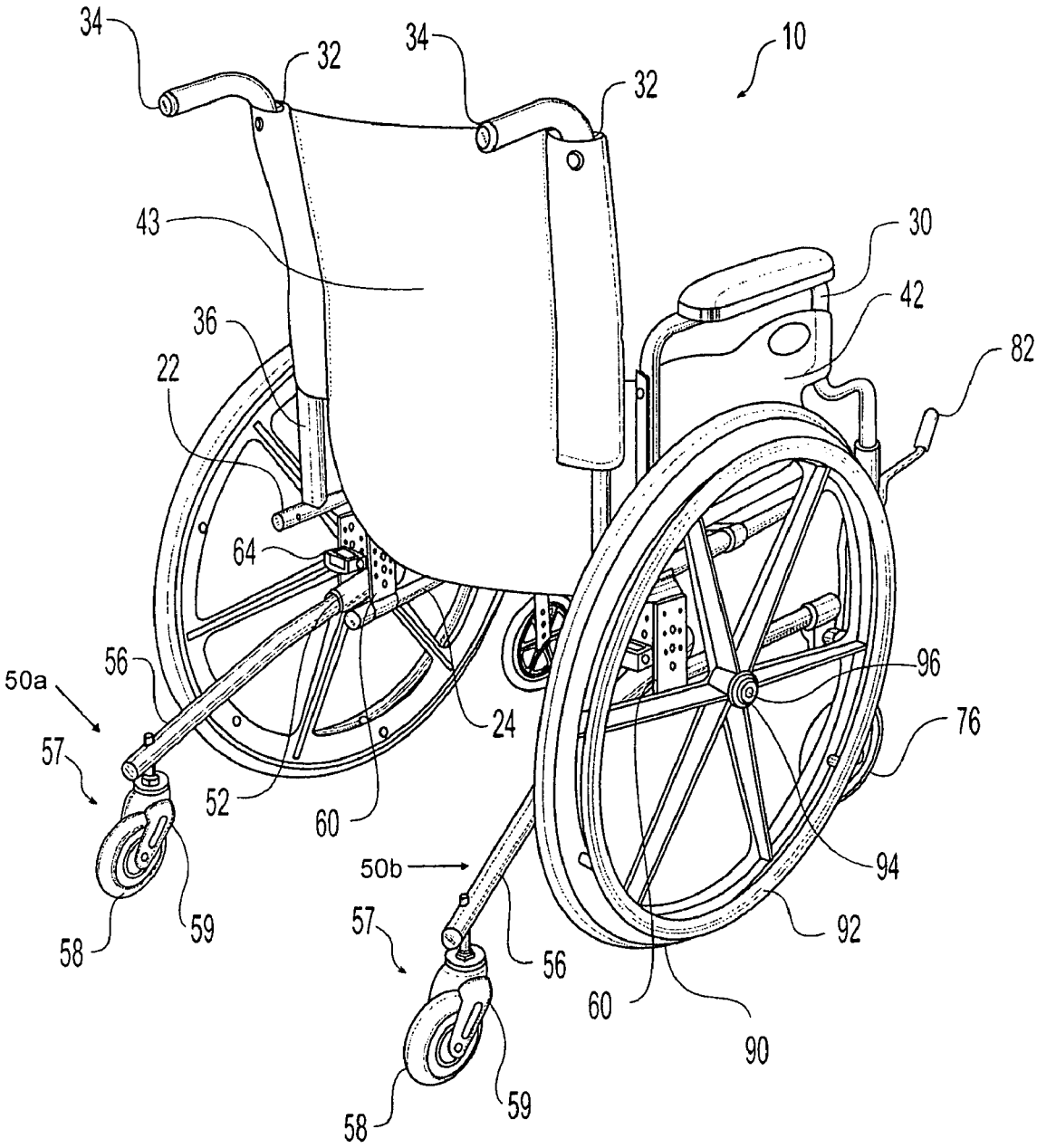
FIG. 7 is a rear perspective view of the exemplary embodiment of FIG. 1 showing an exemplary configuration of the pivot arm and rear caster subassemblies relative to the frame of the wheelchair.

As partially shown in FIG. 7, seat support brackets 28, seat support 26, arm rest support tubes 30, clothing guards 42, height adjustment tubes 36, back canes 32, and push handles 34 are all found on both the left and right sides of chair 10. Cross braces 38 extend transversely between the left and right sides of the chair and are welded or otherwise attached at one end to their respective seat supports 26 and are so attached to the lower frame tubes 24 by cross brace bracket 40. The cooperation between the cross braces 38, the seat supports 26, and the seat support brackets 28 tends to stabilize the chair when in the open position. A pivot screw 39 is mounted within cross brace 38 and allows the chair to collapse into a folded position when not in use, with the seat supports 26 being lifted free of the seat support brackets 28 by the scissor action of the cross braces 38. In the alternative, additional embodiments of the wheelchair according to the present invention may be made with a non-folding frame, e.g., by replacing the collapsible cross braces 38 with lateral supports (not shown) connecting the left-side and right-side frames together.

Again with reference to the exemplary embodiment shown in FIGS. 1-3, front support tubes 25 extend between the upper and lower frame tubes 22, 24 and, in addition to providing stability to each side of the wheelchair 10, provide a surface upon which hinge pins 44 may be mounted. Hinge pins 44 may be used for mounting front riggings 45, e.g., the foot and leg supports (see FIG. 8), on the left and right front portions of the chair. Front support tubes 25 may also serve as a structural support for front caster subassemblies 70. A front caster subassembly 70 may be positioned on each side of the wheelchair 10 and each subassembly 70 may include caster headtube 72, fork 74, which is mounted to caster headtube 72, and front caster 76, which is mounted to fork assembly 74. Additional embodiments of the wheelchair of the present invention need not include caster wheels; other types of wheels or other substrate engaging surfaces could also be used.

With reference to FIGS. 1-2 and 5-6, an exemplary location of the drive wheels 90 relative to frame 20 is shown. The position of drive wheels 90 in the exemplary embodiment shown in FIGS. 1-8 improves the overall maneuverability of the wheelchair 10 because the drive wheels are attached to or mounted on the chair at a position more forward than the typical mounting position of prior art manual wheelchairs. Rather than mounting the drive wheels to be in line with the center of the seat back, in exemplary embodiments of the present invention, drive wheel axis 96 may be positioned between about 3.25 inches (8.26 cm) and 5.50 inches (14.0 cm) forward of the back cane 32 centerline, e.g. 4.75 inches (12.1 cm), or between about 1.0 inches (2.54 cm) and about 3.50 inches (8.89 cm) forward of pivot point 62, e.g. 1.63 inches (4.14 cm). It should be apparent, that the drive wheels 90 could also be positioned at other locations outside of the boundaries of these ranges in additional embodiments of the wheelchair of the present invention. Positioning the drive wheels more forward on the frame 20 improves maneuverability because: (i) the drive wheels support a greater percentage of the user's weight which, in turn, results in less weight on the smaller diameter front casters, therefore rolling resistance is reduced as is the effort required to lift the front casters over obstacles; (ii) the wheelchair's turning radius is decreased, thereby increasing the user's ability to maneuver in smaller areas; (iii) the user is provided with improved access to the wheel for the purpose of propelling the wheelchair; and (iv) less effort is required to turn the wheelchair because the drive wheels' axis of rotation is closer to the user's center of gravity. In the exemplary embodiments of the present invention shown, the rearward stability of the chair is increased by mounting at least one pivot arm and rear caster subassembly to the frame 20 of the wheel chair behind the drive wheels, as shown in the Figures. However, it should be apparent that all embodiments of the wheelchair of the present invention need not include drive wheels that are more forwardly mounted than conventional wheelchairs. Rather, additional embodiments of the wheelchair may include drive wheels that are located in a similar location as conventional wheelchairs.

Figure 4:
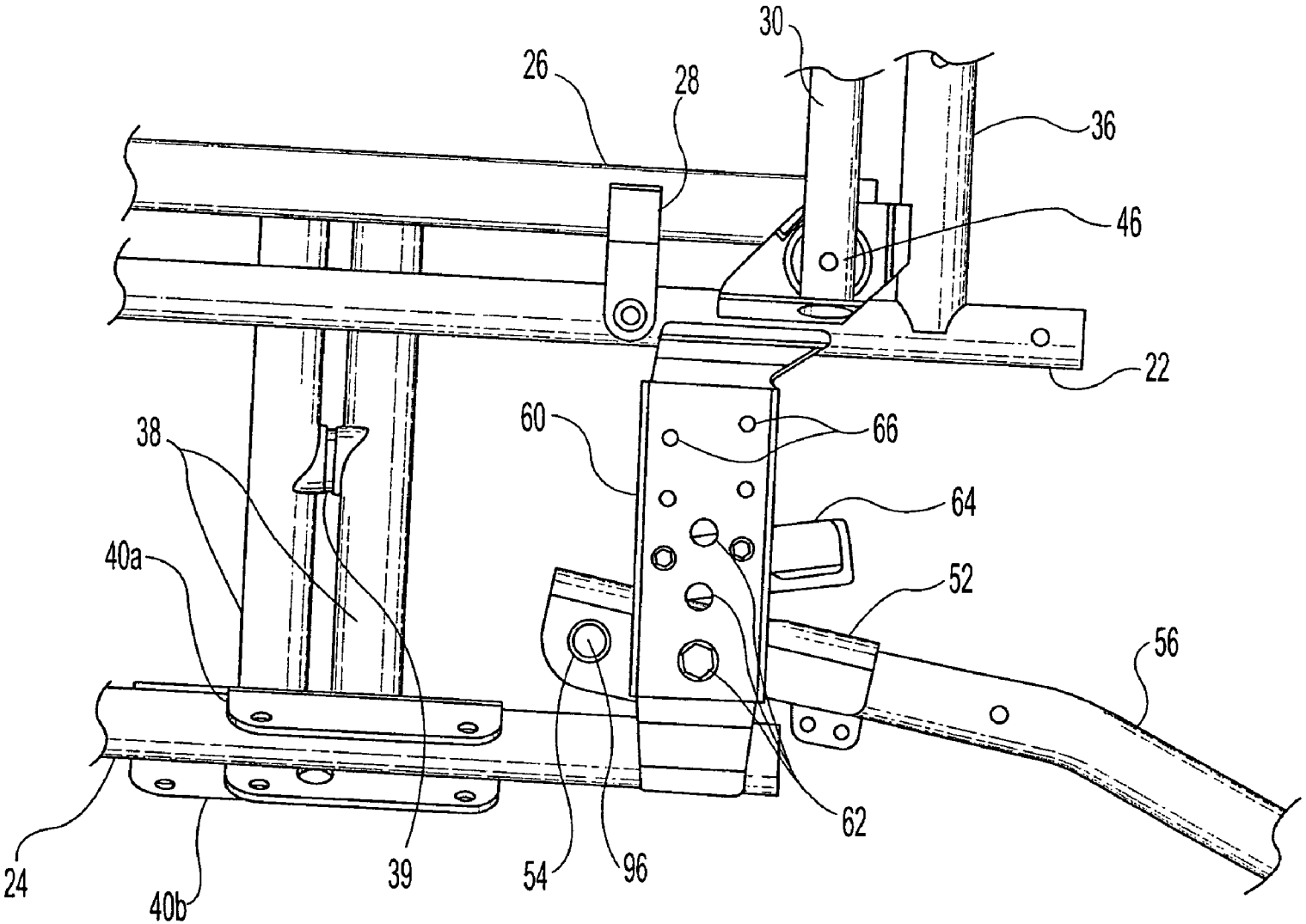
FIG. 4 is a closer view of a portion of FIG. 3 showing the exemplary pivot arm attached to the frame via an exemplary pivot arm bracket and an exemplary mounting bracket.

With reference now to FIGS. 1-4, and particularly to FIG. 4, the exemplary embodiments shown in the Figures may include a system for preventing wheelchair 10 from tipping over backwards while an individual is seated in the chair. Exemplary embodiments may include a pivot arm having an associated caster pivotally connected to the frame 20 on at least one side of the wheelchair. In the first exemplary embodiment shown, a pivot arm and rear caster subassembly 50*a*, 50*b* is pivotally attached to each side of frame 20 and provides a mechanism for allowing the chair to tilt or rotate in a backwards direction without falling over. When viewing chair 10 from behind (see FIG. 7) first pivot arm and rear caster subassembly 50*a* is mounted to the left side portion of frame 20 and second pivot arm and rear caster subassembly 50*b* is mounted to the right side portion of frame 20. Thus, from a functional perspective, the two pivot arm and rear caster subassemblies 50*a*, 50*b* provide increased rearward stability to a chair that includes more forwardly mounted drive wheels, as discussed above. In some embodiments of the present invention, a single pivot arm and rear caster subassembly may be utilized for preventing wheelchair 10 from tipping over backwards when in use. As previously mentioned, the pivot arm need not include caster wheels; other types of wheels or other substrate engaging surfaces could also be used.

Considering one of the two pivot arm subassemblies 50*a*, 50*b*, in the exemplary shown in FIGS. 1-7, the pivot arms are connected to the frame 20 via a pair of pivoting brackets 52. As shown in FIG. 4, a pivot adjustment bracket 60, or "mounting bracket" 60 may be attached to or formed integrally with each side of frame 20 between upper frame tube 22 and lower frame tube 24 (see FIG. 4) and may also provide additional structural support for drive wheel 90, pivot arm 56, rear caster subassembly 57 (and as such may be considered to be part of the frame 20). In the specific embodiment shown in FIGS. 1-7, pivot arm 56 is attached to one end of pivot arm bracket 52 and pivot arm bracket 52 is pivotally attached at its proximal end to mounting bracket 60 at one of three possible pivot points 62 by a pivot screw or similar device. The inclusion of multiple attachment points for pivot arm 56 allows the pivot arm to be adjusted upward or downward on the frame 20 if necessary to adjust to user comfort. In other embodiments, additional attachment points may be included for the purpose of adjusting the pivot arms in a horizontal direction. Additional embodiments of the wheelchair of the present invention could also be provided with a mounting bracket 60 that could be selectively mounted to multiple attachment points on the frame 20. The selective mounting of the mounting bracket 60 to different locations on the frame 20 would effectively allow the pivot arm subassemblies to be adjusted relative to the frame 20.

Figure 9:
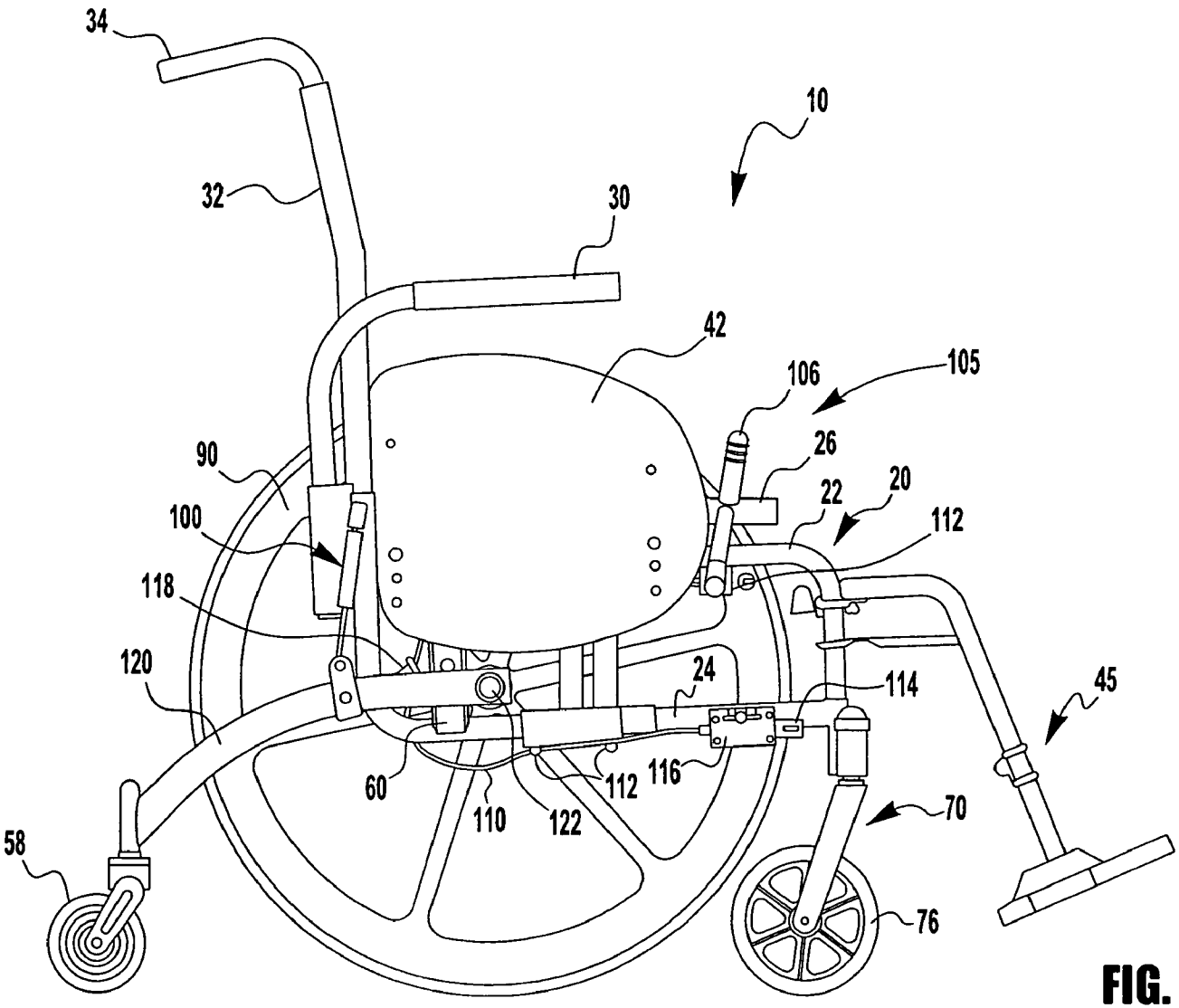
FIG. 9 is a side view of another exemplary embodiment of a wheelchair of the present invention wherein one of the drive wheels has been removed to better show the frame of the wheelchair, one of the pivot arm and rear caster subassemblies, and one of the wheel lock subassemblies.
Figure 10:
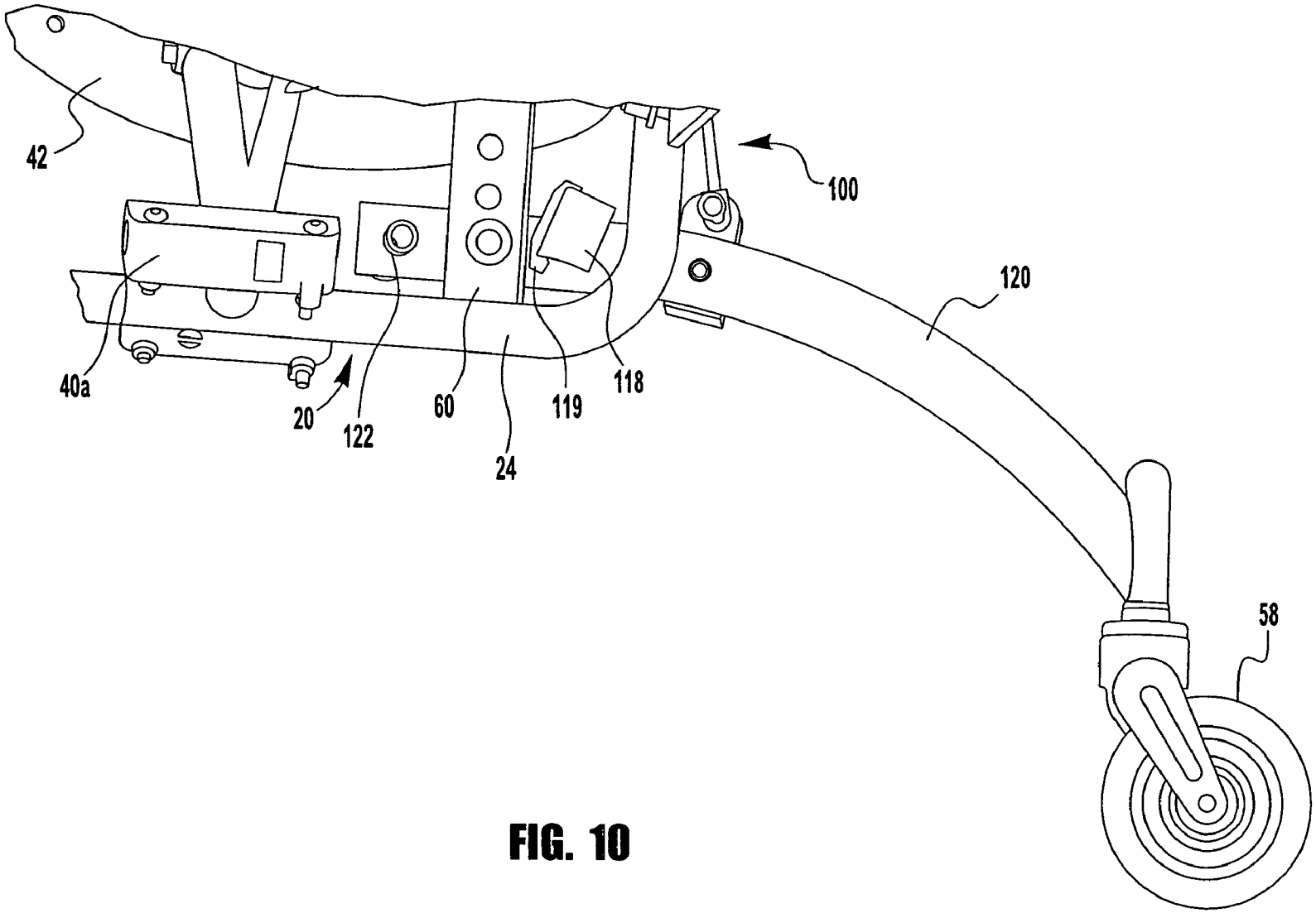
FIG. 10 is a magnified perspective view of a portion of the anti-tip wheelchair of FIG. 9 wherein both of the drive wheels have been removed to better show the pivot arm, a portion of the frame and the tilt-stop.
Figure 11:
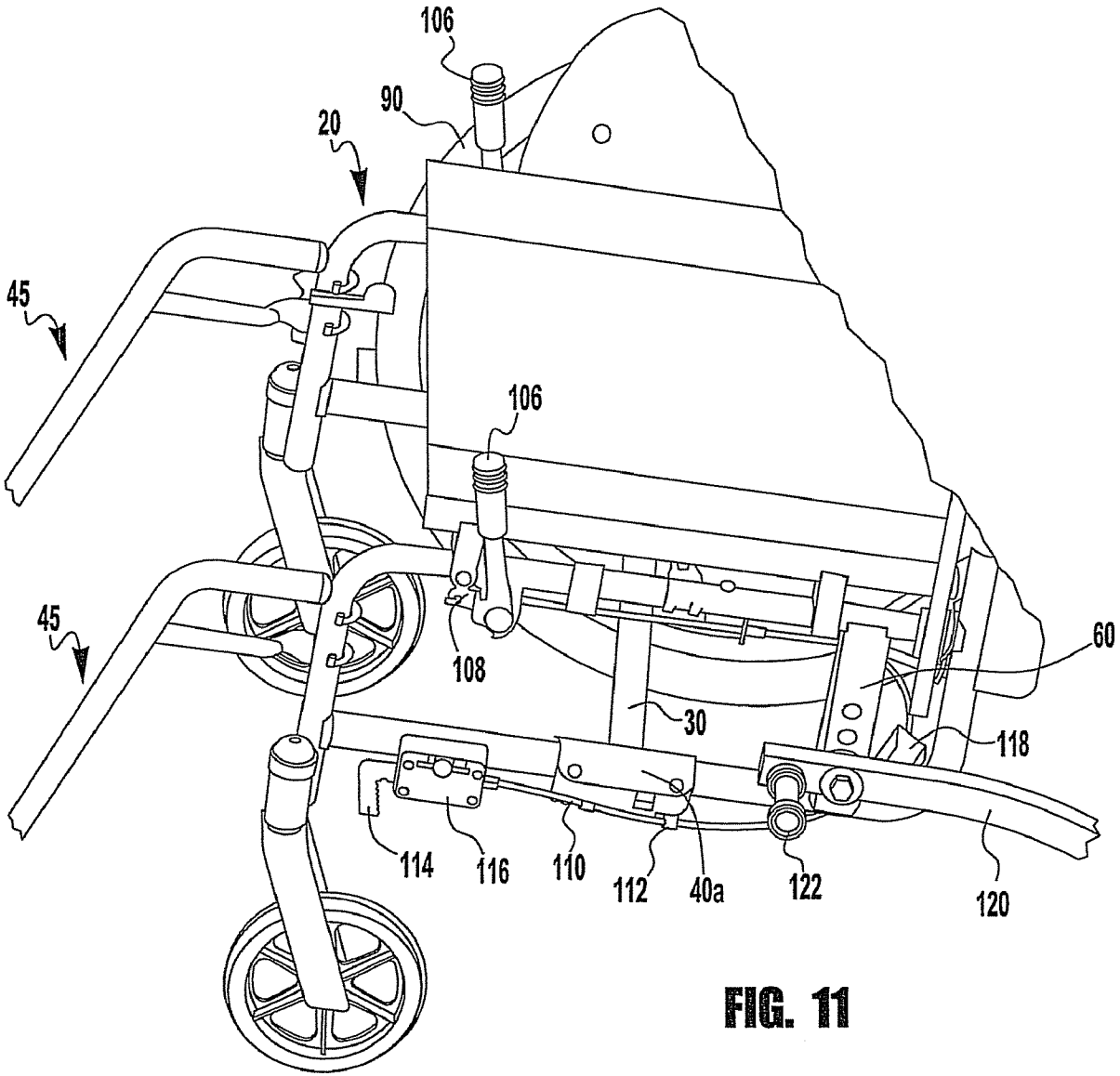
FIG. 11 is a magnified perspective view of a portion of the anti-tip wheelchair of FIG. 9 showing an exemplary cable operated wheel lock.

As shown in FIGS. 9-11, additional embodiments of the wheelchair 10 may include a pivot arm 120 that does not include a pivot arm bracket 52. Rather, the drive wheels 90 are directly mounted to the pivot arm 120 by wheel mount 122, which may be an axle mounted directly to the pivot arm 120, an axle bushing or other opening defined within the pivot arm 120 adapted to accept an axle, or any other suitable wheel attachment means. The pivot arm 120 is directly mounted to the mounting bracket 60 thereby mounting both the pivot arm 120 and the drive wheels 90 to the frame 20. In additional embodiments of the wheelchair of the present invention, the pivot arm 120 could include multiple attachment points for attaching both the drive wheels 90 and mounting bracket 60 to multiple locations of the pivot arm 120.

The drive wheels 90 each have an axis of rotation 96. As best shown in FIG. 4, the drive wheels 90 may be rotatably mounted to the arm assemblies 50*a*, 50*b* via a drive wheel axle bushing 54 inserted into pivot arm bracket 52 ahead or in front of pivot point 62. When the wheelchair 10 is assembled (see FIGS. 5-7), drive wheels 90 are mounted on axle bushings 54 with axle mounting screws 94 or similar devices. Thus, in the exemplary embodiments shown in FIGS. 1-7, drive wheels 90 and pivot arms 56 are both supported by pivot arm bracket 52, which is attached to mounting bracket 60. Thus, in the exemplary embodiment shown in FIGS. 1-7, the drive wheels 90 are not directly attached to the frame 20 of the chair, but rather are indirectly attached to the frame via pivot arm bracket 52. As shown, the drive wheel attachment point, e.g., drive wheel axis 96, is separate and forward with respect to the point 62 at which pivot arm 56 pivotally attaches to the frame 20 of the wheelchair, thereby making it possible to move the position of the drive wheels forward. As previously described, positioning drive wheels 90 more forward on frame 20 makes wheelchair 10 easier to propel with hand rims 92, provides a smaller overall turn radius, and requires less effort on the part of the user to tilt the chair backwards to raise front casters 70 for the purpose of clearing obstacles. In other embodiments of this invention, pivot arm bracket 52 may include multiple positions for mounting drive wheel 90 to the pivot arm bracket 52 as well as including multiple pivot attachment points 62 for mounting pivot arm bracket 52 on the mounting bracket 60.

Due to the configuration of the anti-tip mechanism of the embodiments of the present invention, both the drive wheels 90 and the pivot arm subassemblies 50*a* and 50*b* each support a portion of the weight of the wheelchair and a user who is seated in the wheelchair, thereby lending a high degree of overall stability to the chair. Also, since the drive wheels do not bear the entire weight of the wheelchair and the user, they are more easily driven and are more maneuverable than they otherwise would be. The addition of the anti-tip mechanism allows the drive wheel to be more forwardly mounted than on chairs that do not include such devices. Thus, the flexibility and stability provided by the embodiments of the present invention confers a degree of safety and maneuverability above and beyond that of current state of the art wheelchairs.

The pivot arm 56 of both pivot arm and rear caster assemblies 50*a*, 50*b* extends rearward from frame 20 and, in the exemplary embodiment, includes a slight downward bend or angle (see FIG. 1) that allows the pivot arm, in combination with rear caster 58, to make contact with the substrate across which the wheelchair 10 will be traveling. The pivot arms 56 however are not limited to this shape and they could be shaped and configured differently in additional embodiments. In exemplary embodiments of the present invention, the rear caster wheel 58 may be positioned between about 12.5 inches (31.8 cm) and about 18.5 inches (47.0 cm), e.g., 15.6 inches (39.7 cm), behind the drive wheel axis of rotation 96, or between about 8.0 inches (20.3 cm) and about 14.0 inches (35.6), e.g., 10.9 inches (27.6 cm) behind the center of the seat back, i.e., the back cane 32. It should be apparent, that the rear caster wheels 58 may also be positioned at other locations outside of the boundaries of these ranges in additional embodiments of the wheelchair of the present invention.

Under certain operating conditions, such as when wheelchair 10 is traveling across uneven surfaces, pivot arm 56 will rotate around pivot point 62. Likewise, if the frame 20 is rotated clockwise (with respect to FIGS. 1-6), such as when (a) downward force is applied to push handle 34 (see arrow "A" in FIG. 2 and arrow "D" and FIG. 6) or (b) the user leans back in the chair and/or relatively quickly rotates the wheel in a counter-clockwise fashion (with respect to FIGS. 1-6), the pivot arm 56 and frame 20 will rotate relative to each other at pivot point 62 in response to the motion(see arrow "B" in FIG. 2). Likewise, if force is applied to the pivot arms from below, such as when one or both of the casters 58 encounters an obstacle, one or both of the pivot arms (see arrow "C" in FIG. 3) will rotate upward in response to the force. While some rotation of the pivot arms is desirable for achieving stability and proper motion of the wheelchair, it is undesirable for the frame 20 and the pivot arms 56 to rotate relative to each other beyond a certain point. To prevent excessive rotation of the pivot arms 56 and frame 20 relative to each other, a positive stop 64 may be provided. The stop 64 may be provided as a "tilt-stop" 64 connected to the pivot adjustment bracket or mounting bracket 60 as shown in the figures, which may be detachably mounted on each of the plurality of apertures 66 as best shown in FIG. 4. Additional embodiments of the present invention may include any number of tilt stops.

In the exemplary embodiment shown in FIGS. 1-7, each positive stop 64 is a device that engages one of the pivot arms 56 to prevent excessive rotation of the pivot arm 56 and frame 20 relative to each other (see FIG. 3). Based on the height or other requirements of the user, the seat to floor distance of wheelchair 10 can be altered by adjusting the position of front caster 76 within fork 74 or by making other adjustments of the frame 20, drive wheels 90 or other portion of the wheelchair 10. If the seat to floor distance is adjusted, the position of pivot arms 56 on mounting bracket 60 should be adjusted accordingly. Thus, if pivot arms 56 are relocated to a different pivot point 62 on mounting bracket 60, positive stop 64 can be relocated to a higher or lower location on mounting bracket 60 by using plurality of apertures 66 as alternate attachment points. Positive stop 64 may also be adjustable to accommodate different degrees of tilting. For example, the angle of the positive stop may be adjusted to allow the wheelchair to tilt far enough back that the user can maintain the wheelchair in a stable, tilted position for a prolonged period of time. As a result, a user who was seated in an embodiment of the wheelchair 100 could tilt the wheelchair back into the stable, tilted position with the front caster assembly 70 raised off of the ground or other substrate being traversed and remain in this stable, tilted position. A user of an embodiment of the wheelchair 100 of the present invention could also operate the wheelchair in this stable, tilted position. This would allow the user to approach a curb or other obstacle with the front caster assembly 70 in a raised position until the drive wheels 90 contact the obstacle. The user could then proceed to urge the drive wheels onto, or over, the obstacle and thereby traverse the obstacle. It should be apparent, that a caregiver could also assist who is pushing the wheelchair 100 could also assist the user in traversing such an obstacle.

As illustrated in FIGS. 9-11, a positive stop device 118 may also be mounted to the pivot arm 120 and contact the mounting bracket 60 to limit the rotation of the pivot arm 120 and frame 20 relative to each other. The location of the positive stop device 118 could be adjustable, i.e the positive stop device 118 could be mounted to multiple locations of the pivot arm 120. In additional embodiments, the positive stop device 118 could contact another portion of the wheelchair 10, for example a portion of the frame 20. The positive stop device 118 illustrated in FIGS. 9-11 includes a pad 119 fashioned from rubber, plastic, polyurethane, or another suitable material for cushioning the contact between the positive stop 118 and the mounting bracket 60. The positive stop device 118 may be provided without such a pad 119 in additional embodiments. Additional embodiments of the wheelchair of the present invention could include various tilt stop pads (not shown) that possess various shapes and thicknesses. The shape of such tilt stop pads could be used to adjust the manner in which the positive stop device 118 contacts the frame 20, namely the location and the angle of such contact. Accordingly, by selecting from a variety of differently shaped tilt stop pads, the amount that the frame 20 and pivot arm 120 are capable of rotating relative to each other could be adjusted.

Figure 8:
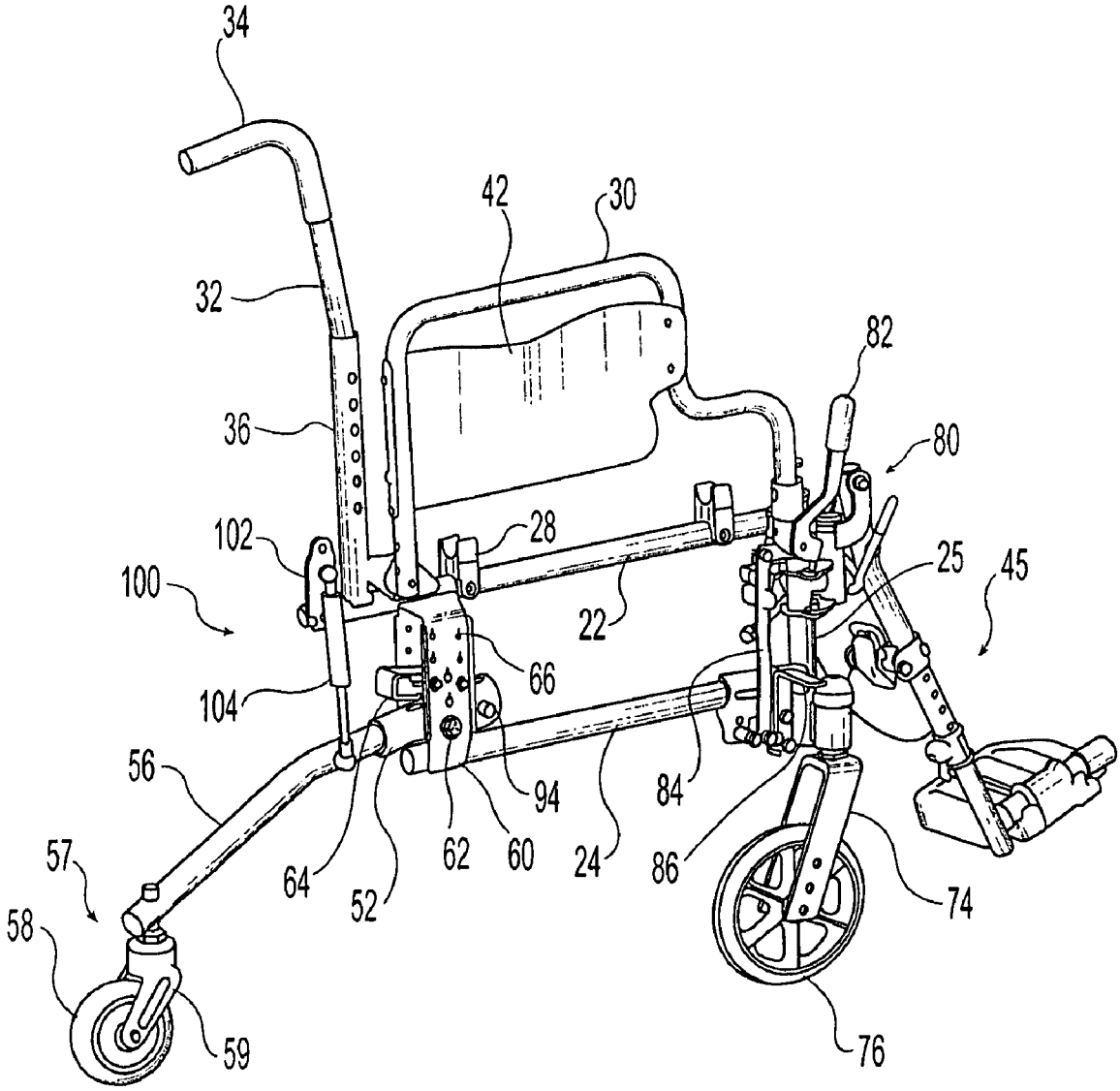
FIG. 8 is a rear perspective view of a portion of another exemplary embodiment of the present invention showing, in addition to the structures shown in FIGS. 1-7, an exemplary resistance device subassembly attached to the frame and the pivot arm.

In the embodiment of anti-tip wheelchair 10 shown in FIG. 8, a resistance subassembly 100 has been added to provide increased resistance in situations where the wheelchair (i.e., the wheelchair frame) is tipped backwards. On each side of the wheelchair shown, a bracket 102 may be attached to the rear portion of upper frame tube 22. One end of a resistance device 104 is attached to bracket 102 and the other end of resistance device 104 is attached to pivot arm 56. Essentially, resistance device 104 is a relatively small shock absorber, pressurized gas device, torsion spring, compression spring, other type of spring, dashpot, hydraulic device, or any similar device capable of providing sufficient resistance or dampening force. As the user leans backwards in the chair or tips the chair in a backwards direction (e.g., by rapidly rotating the wheels clockwise), resistance device 104 activates and prevents unrestricted or uncontrolled tipping of the wheelchair. Thus, resistance subassembly 100 confers an additional degree of safety and stability to wheelchair 10.

Figure 5:
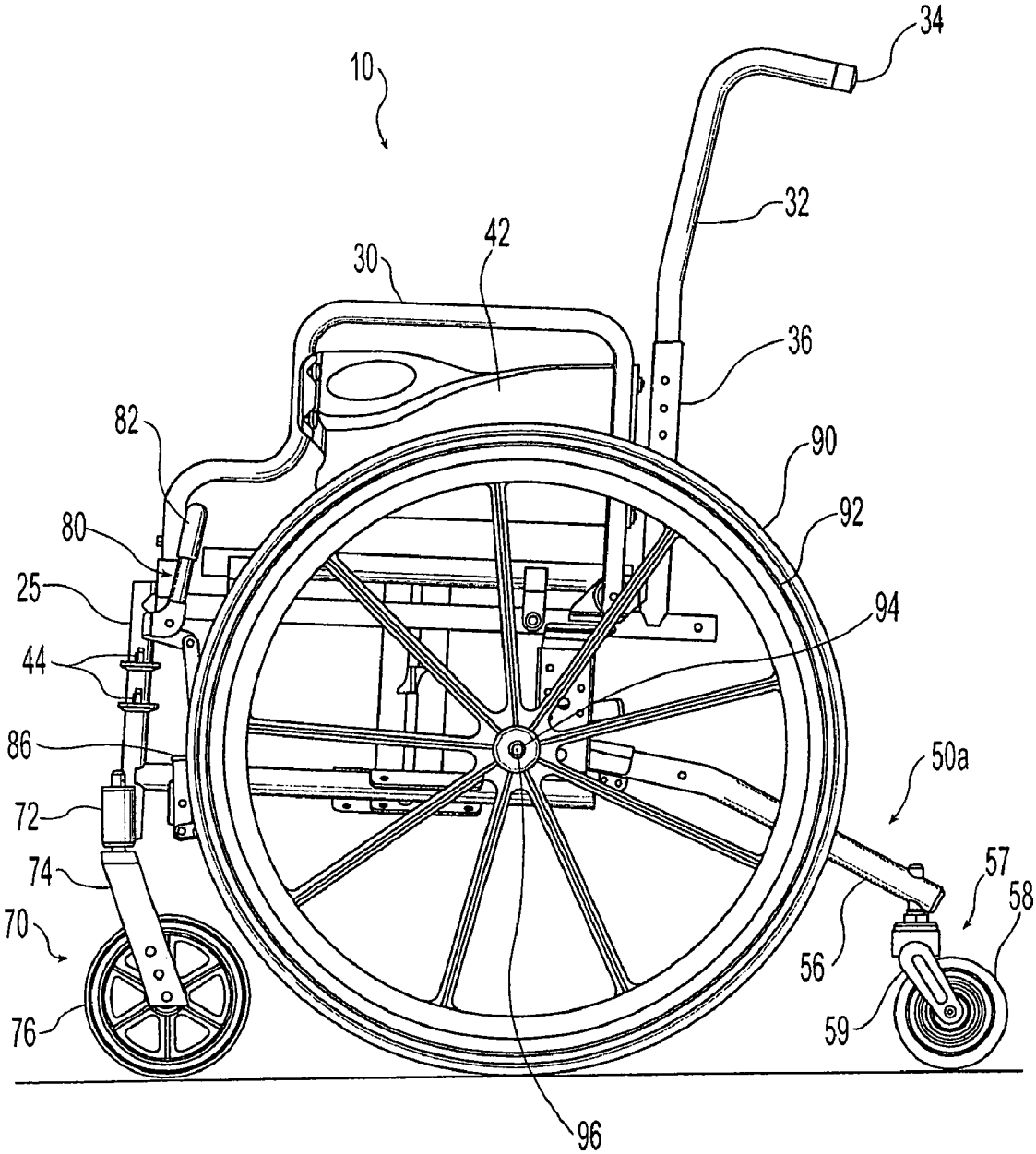
FIG. 5 is a side view of the exemplary embodiment of FIG. 1 showing exemplary placement of one of the pivot arm and rear caster subassemblies and one of the wheel lock subassemblies.
Figure 6:
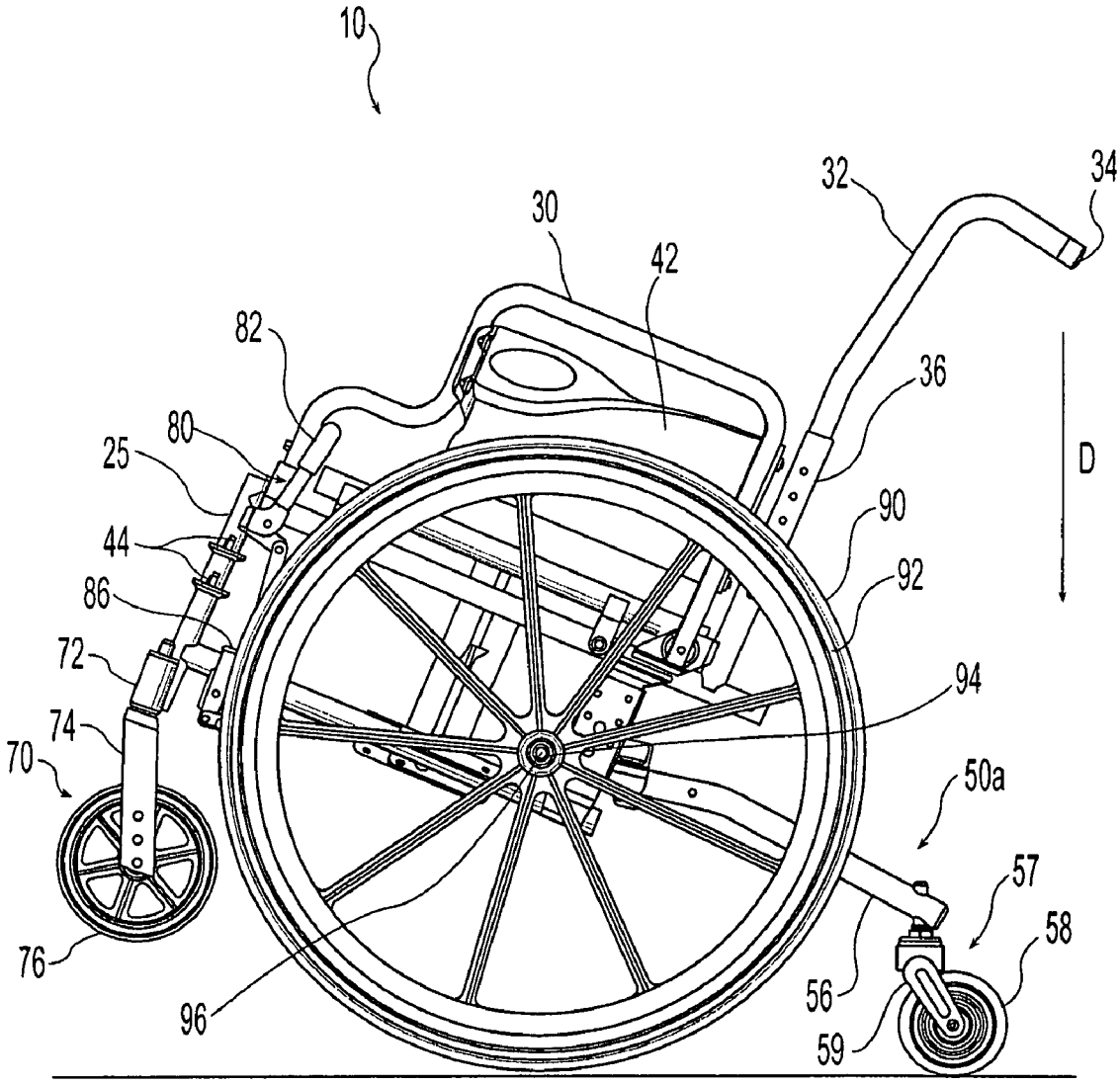
FIG. 6 is a side view of the exemplary embodiment of FIG. 1 showing the wheelchair in a position after the seat is rotated backwards.

Exemplary wheelchairs according to the present invention may include a drive wheel lock. As best shown in FIGS. 1 and 5, an exemplary wheel lock subassembly 80 is shown mounted to the front side portion of frame 20 and includes a handle 82 for applying the wheel lock, a brake shoe 86 for engaging drive wheel 90, and a plurality of interconnected links 84 that transfer force from handle 82 to shoe 86 for the purpose of applying the wheel lock. Links 84 also provide a connection between handle 82 and brake shoe 86 which makes the wheel lock easier to operate because handle 82 is located closer to the user. As shown in FIG. 5, in the exemplary embodiment, shoe 86 engages drive wheel 90 below its central axis 96. Positioning shoe 86 in this manner provides increased locking force to the wheel when the chair is tilted back, thereby reducing the likelihood of inadvertent release of the wheel lock. In the exemplary embodiment, a wheel lock subassembly 80 is installed on both sides of wheelchair 10.

In the alternative, embodiments of the present invention may have a wheel lock subassembly 80 mounted on either pivot arm 56 or pivot arm bracket 52, rather than on frame 20 (or in addition thereto) (not shown in the Figures). Mounting the wheel lock subassembly in this manner reduces the relative motion between the wheel lock and the drive wheel when the chair is tilted backwards. The wheel lock subassembly could also be mounted on other portions of the wheelchair.

In additional embodiments, wheel lock subassembly 80 may be controlled remotely by a control cable or similar control means. For example, FIGS. 9 and 11 illustrate a cable operated wheel lock subassembly 105. The cable operated wheel lock subassembly 105 is mounted to the front side portion of frame 20 and includes a handle 106 which is mounted to the frame by bracket 108. The handle is mechanically connected with a cable 110. Optionally, the cable may be attached to the cross brace bracket 40 or other portion of the wheelchair 10 by one or more cable mounting clips 112.

The cable mounting clips 112 help to ensure that the cable remains in its desired position and does not become entangled on portions of the wheelchair or other objects. The cable is mechanically connected to the wheel engaging element 114 that is mounted to lower frame tube 24 by housing 116 and transfers force from the handle 106 to the wheel engaging element 114. When the handle 116 of the wheel lock subassembly 105 of the illustrated embodiment is pulled towards or pushed away from a user seated in the wheelchair, the cable 114 causes the wheel engaging element 114 to engage the wheel. It should be apparent that additional embodiments could include wheel locks that were controlled by devices other than handles. The configuration of the cable 110 allows the handle 106 to be mounted to the frame 20 at a location that makes the handle 106 easily accessed by the user of the chair. As shown in FIG. 9, the location or point at which engaging element 114 contacts wheel 90 is also below the central axis of wheel 90. It should be apparent that many other configurations of linkage operated or cable operated wheel locks could be used as well as other types of wheel locks.

In still other exemplary embodiments of this invention not shown in the Figures, wheel lock subassembly 80 may include any one or more of the following: (i) a pin that engages a disc with holes or slots that is attached to the drive wheel; (ii) brake pads that engage a disc or plate attached to the drive wheel; or (iii) a pin attached to the drive wheel that engages a hole or slot on the frame or pivot arm. It should be apparent that some embodiments of the wheelchair of the present invention may be provided without a wheel lock.

Additional embodiments of the wheel chair of the present invention may also include an optional tilt prevention device (not shown). Such a device could me mounted on the frame 20, pivot arm 56, or other portion of the wheelchair and be selectively engaged to prevent any rotation of the wheelchair frame 20 and pivot arm 56 relative to each other. Such a device could be utilized if the user of the wheelchair does not want the frame 20 and pivot arms 56 to be able to rotate relative to each other at all, such as when the wheelchair is located in a car, bus or other moving vehicle.

While the present invention has been illustrated by the description of exemplary embodiments thereof, and while the embodiments have been described in some detail, it is not the intention of the applicant to restrict or in any way limit the scope of the appended claims to such detail. Additional advantages and modifications will readily appear to those skilled in the art. Therefore, the invention in its broader aspects is not limited to any of the specific details, representative apparatus and methods, and illustrative examples shown and described. Accordingly, departures may be made from such details without departing from the spirit or scope of the applicant's general inventive concept.

What is claimed:

1. A manually powered anti-tip wheelchair, comprising:

a frame, the frame providing structural support for a seat;

a pair of drive wheels, each of the pair of drive wheels having an axis of rotation;

at least one front wheel mounted to a portion of the frame;

at least one anti-tip assembly, comprising:

(i) a pivot arm, the pivot arm including a wheel;

(ii) a drive wheel attachment point for attachment of at least one drive wheel to the anti-tip assembly; and (iii) a frame attachment point, separate from and located rearward of the drive wheel attachment point, adapted to rotatably mount the anti-tip assembly to the frame, the at least one drive wheel and the pivot arm thereby being mounted to the frame, wherein the at least one drive wheel and pivot arm wheel are both adapted to contact a ground surface when the wheelchair is in use, wherein the at least one drive wheel and pivot arm wheel each support a portion of the weight of the frame of the wheelchair when in contact with the ground surface, and wherein the frame may rotate relative to the anti-tip assembly while the at least one drive wheel and pivot arm wheel remain in contact with the ground surface; and a stop device mounted on one of the pivot arm or the frame, the stop device selectively contacting the other of the pivot arm or the frame to limit the movement of the frame and pivot arm relative to each other, the stop device positioned to permit the frame to tilt back into a predetermined stable tilted position with the at least one front wheel in a raised position in such a manner that a user may sit in the seat of the wheelchair with the at least one front wheel engaging the ground surface, tilt the frame back into the predetermined stable tilted position, and operate the wheelchair with the at least one front wheel in the raised position.

2. The manually powered anti-tip wheelchair of claim 1, wherein said stop device is mounted to the frame and engages the anti-tip subassembly to limit the movement of the frame and anti-tip subassembly relative to each other.

3. The manually powered anti-tip wheelchair of claim 2, wherein the frame further comprises a plurality of separate stop device attachment points for attaching said stop device.

4. The manually powered anti-tip wheelchair of claim 1, wherein said stop device is mounted to the anti-tip assembly and engages the frame to limit the movement of the frame and anti-tip assembly relative to each other.

5. The manually powered anti-tip wheelchair of claim 4, wherein the anti-tip assembly further comprises a plurality of separate stop device attachment points for attaching said stop device.

6. The manually powered anti-tip wheelchair of claim 1, wherein said drive wheel attachment point of the anti-tip assembly is located on the pivot arm.

7. The manually powered anti-tip wheelchair of claim 1, wherein said drive wheel attachment point of the anti-tip assembly is connected with the pivot arm.

8. The manually powered anti-tip wheelchair of claim 1, wherein said at least one front wheel is a caster wheel.

9. The manually powered anti-tip wheelchair of claim 1 further comprising a resistance device, the resistance device engaging with the frame and the anti-tip assembly to resist the movement of the frame and anti-tip assembly relative to each other.

10. The manually powered anti-tip wheelchair of claim 9, wherein said resistance device is mounted to the frame and engages the anti-tip assembly to resist the movement of the frame and anti-tip assembly relative to each other.

11. The manually powered anti-tip wheelchair of claim 9, wherein said resistance device is mounted to the anti-tip assembly and engages the frame to resist the movement of the frame and anti-tip assembly relative to each other.

12. The manually powered anti-tip wheelchair of claim 9 wherein said resistance device includes at least one spring.

13. The manually powered anti-tip wheelchair of claim 9 wherein said resistance device comprises a gas pressurized spring.

14. The manually powered anti-tip wheelchair of claim 1 further comprising a wheel lock including a wheel engaging element selectively moveable to engage at least one of the pair of drive wheels below the axis of rotation of said at least one of the pair of drive wheel.

15. The manually powered anti-tip wheelchair of claim 1 wherein the frame includes multiple, discrete anti-tip assembly attachment points to allow for attachment of the anti-tip assembly at different locations on the frame.

16. The manually powered anti-tip wheelchair of claim 1 wherein the anti-tip assembly includes multiple, discrete frame attachment points to allow for attachment of the frame at different locations on the anti-tip subassembly.

17. The manually powered anti-tip wheelchair of claim 1 wherein the anti-tip assembly includes multiple, discrete drive wheel attachment point for attachment of at least one drive wheel at different locations on the anti-tip subassembly.

18. The manually powered anti-tip wheelchair of claim 1 further comprising a wheel lock including a wheel engaging element selectively moveable to engage at least one of the pair of drive wheels below the axis of rotation of said at least one of the pair of drive wheel; and wherein the frame includes multiple, discrete anti-tip assembly attachment points to allow for attachment of the anti-tip assembly at different locations on the frame.

19. A manually powered anti-tip wheelchair, comprising:

a frame, the frame providing structural support for a seat;

a pair of drive wheels, each of the pair of drive wheels having an axis of rotation;

at least one front wheel mounted to a portion of the frame;

at least one anti-tip assembly, comprising:

(i) a pivot arm, the pivot arm including a wheel;

(ii) a drive wheel attachment point for attachment of at least one drive wheel to the anti-tip assembly, wherein the at least one drive wheel attaches directly to the pivot arm via the drive wheel attachment point; and (iii) a frame attachment point, separate from and located rearward of the drive wheel attachment point, adapted to rotatably mount the anti-tip assembly to the frame, the at least one drive wheel and the pivot arm thereby being mounted to the frame, wherein the at least one drive wheel and pivot arm wheel are both adapted to contact a ground surface when the wheelchair is in use, wherein the at least one drive wheel and pivot arm wheel each support a portion of the weight of the frame of the wheelchair when in contact with the ground surface, and wherein the frame may rotate relative to the anti-tip assembly while the at least one drive wheel and pivot arm wheel remain in contact with the ground surface; and at least one wheel lock including a wheel engaging element selectively moveable to engage at least one of the pair of drive wheels below the axis of rotation of the at least one of the pair of drive wheels.

20. The manually powered anti-tip wheelchair of claim 19, wherein the frame includes multiple, discrete anti-tip assembly attachment points to allow for attachment of the anti-tip assembly at different locations on the frame.

21. A manually powered anti-tip wheelchair, comprising:

a frame, the frame providing structural support for a seat;

a pair of dhive wheels, each of the pair of drive wheels having an axis of rotation;

at least one front wheel mounted to a portion of the frame;

at least one anti-tip assembly, comprising:

(i) a pivot arm, the pivot arm including a wheel;

(ii) a drive wheel attachment point for attachment of at least one drive wheel to the anti-tip assembly, wherein the at least one drive wheel attaches directly to the pivot arm via the drive wheel attachment point; and (iii) a frame attachment point, separate from and located rearward of the drive wheel attachment point, adapted to rotatably mount the anti-tip assembly to the frame, the frame having multiple discrete anti-tip assembly attachment points to allow for attachment of the anti-tip assembly at different locations on the frame, the at least one drive wheel and the pivot arm thereby being mounted to the frame, wherein a portion of the at least one drive wheel and pivot arm wheel are both adapted to contact a ground surface when the wheelchair is in use, wherein the at least one drive wheel and pivot arm wheel each support a portion of the weight of the frame of the wheelchair when in contact with the ground surface, and wherein the frame may rotate relative to the anti-tip assembly while the at least one drive wheel and pivot arm remain in contact with the ground surface; and a stop device mounted on one of the pivot arm or the frame, the stop device selectively engaging the other of the pivot arm or the frame to limit the movement of the frame and pivot arm relative to each other.

22. A manually powered anti-tip wheelchair, comprising:

a frame, the frame providing structural support for a seat;

left and right drive wheels, each of the drive wheels having an axis of rotation;

at least one front caster mounted to a portion of the frame;

a pair of anti-tip assemblies, comprising:

(i) a pivot arm having front and rear ends;

(ii) a rear caster wheel mounted to the pivot arm proximate the rear end of the pivot arm and the pivot arm further having an associated one of the drive wheels mounted to the pivot arm at a drive wheel attachment point proximate the front end of the pivot arm; and (iii) a frame attachment point, located on the pivot arm between the rear caster wheel and the drive wheel attachment point, adapted to rotatably mount the pivot arm and the associated one of the drive wheels to the frame;

(a) wherein the associated one of the drive wheels and the rear caster wheel are both adapted to contact a ground surface when the wheelchair is in use; and (b) wherein the frame may rotate relative to the pivot arm while the associated one of the drive wheels and the rear caster wheel remain in contact with the ground surface; and a stop device mounted on one of the pivot arm or the frame, the stop device selectively engaging the other of the pivot arm or the frame to limit the movement of the frame and the pivot arm relative to each other, the stop device positioned to permit the frame to tilt back into a predetermined stable tilted position with the at least one front caster in a raised position in such a manner that a user may sit in the seat of the wheelchair with the at least one caster engaging the ground surface, tilt the frame back into the predetermined stable tilted position, and operate the wheelchair with the at least one front caster in the raised position.

23. The manually powered anti-tip wheelchair of claim 22, wherein the at least one caster is raised high enough off of the ground surface while the frame is in the predetermined stable tilted position that the at least one front caster clears an obstacle that is about six inches high as the manually powered anti-tip wheelchair is operated on the ground surface toward the obstacle so that the drive wheels contact the obstacle.

24. The manually powered anti-tip wheelchair of claim 22, wherein the at least one caster is raised high enough off of the ground surface while the frame is in the predetermined stable tilted position that the at least one front caster clears an obstacle as the manually powered anti-tip wheelchair is operated on the ground surface toward the obstacle so that the drive wheels contact the obstacle.

25. The manually powered anti-tip wheelchair of claim 23 further comprising a wheel lock including a wheel engaging element selectively moveable to engage at least one of the drive wheels below the axis of rotation of the at least one drive wheel.

26. A manually powered anti-tip wheelchair, comprising:

a frame, the frame providing structural support for a seat;

a pair of drive wheels, each of the pair of drive wheels having an axis of rotation;

at least one front wheel mounted to a portion of the frame;

at least one anti-tip assembly, comprising:

(i) a pivot arm, the pivot arm including a wheel;

(ii) a drive wheel attachment point for attachment of at least one drive wheel to the anti-tip assembly, wherein the drive wheel attachment point comprises a location directly on the pivot arm or directly on a pivot arm bracket connected to a projecting end of the pivot arm; and (iii) a frame attachment point, separate from and located rearward of the drive wheel attachment point, adapted to rotatably mount the anti-tip assembly to the frame, the at least one drive wheel and the pivot arm thereby being mounted to the frame, wherein the at least one drive wheel and pivot arm wheel are both adapted to contact a ground surface when the wheelchair is in use, wherein the at least one drive wheel and pivot arm wheel each support a portion of the weight of the frame of the wheelchair when in contact with the ground surface, and wherein the frame may rotate relative to the anti-tip assembly while the at least one drive wheel and pivot arm wheel remain in contact with the ground surface; and a stop device mounted on one of the pivot arm or the frame, the stop device selectively contacting the other of the pivot arm or the frame to limit the movement of the frame and pivot arm relative to each other, the stop device positioned to permit the frame to tilt back into a predetermined stable tilted position with the at least one front wheel in a raised position in such a manner that a user may sit in the seat of the wheelchair with the at least one front wheel engaging the ground surface, tilt the frame back into the predetermined stable tilted position, and operate the wheelchair with the at least one front wheel in the raised position.

* * * * *